US009474312B2

(12) United States Patent
Ulriksen et al.

(10) Patent No.: US 9,474,312 B2
(45) Date of Patent: Oct. 25, 2016

(54) GARMENT WITH AN INCORPORATED MICRO CLIMATE SYSTEM

(71) Applicant: HELLY HANSEN AS, Oslo (NO)

(72) Inventors: Kristoffer Ulriksen, Oslo (NO); Marit Johansen, Oslo (NO); Tor Jenssen, Oslo (NO)

(73) Assignee: HELLY HANSEN AS, Oslo (NO)

( * ) Notice: Subject to any disclaimer, the term of this patent is extended or adjusted under 35 U.S.C. 154(b) by 0 days.

(21) Appl. No.: 14/256,697

(22) Filed: Apr. 18, 2014

(65) Prior Publication Data

US 2014/0310847 A1 Oct. 23, 2014

(30) Foreign Application Priority Data

Apr. 19, 2013 (NO) ..... 20130548

(51) Int. Cl.
*A41D 27/28* (2006.01)

(52) U.S. Cl.
CPC ..... *A41D 27/28* (2013.01); *A41D 2400/20* (2013.01)

(58) Field of Classification Search
CPC ..... A41D 13/0015; A41D 27/28; A41D 2400/20
USPC ..... 2/69
See application file for complete search history.

(56) References Cited

U.S. PATENT DOCUMENTS

| | | | | |
|---|---|---|---|---|
| 4,451,934 | A | 6/1984 | Gioello | |
| 4,479,270 | A * | 10/1984 | Novinger | 2/69 |
| 4,547,906 | A | 10/1985 | Nishida | |
| 5,043,207 | A * | 8/1991 | Donovan et al. | 442/120 |
| 5,515,543 | A * | 5/1996 | Gioello | 2/69 |
| 5,704,064 | A * | 1/1998 | van der Sleesen | 2/69 |
| 5,809,567 | A * | 9/1998 | Jacobs et al. | 2/1 |
| 5,860,163 | A | 1/1999 | Aldridge | |
| 6,260,201 | B1 * | 7/2001 | Rankin | 2/69 |
| 7,735,149 | B2 * | 6/2010 | Jarvis | 2/69 |
| 2006/0070162 | A1 * | 4/2006 | Frank | 2/69 |
| 2008/0263742 | A1 * | 10/2008 | Vaughn | 2/69 |
| 2012/0255098 | A1 * | 10/2012 | Leyva | 2/69 |
| 2013/0232659 | A1 * | 9/2013 | Levian | 2/69 |
| 2013/0276201 | A1 * | 10/2013 | Pezzimenti | 2/69 |
| 2014/0004332 | A1 * | 1/2014 | Kanayama | 428/304.4 |

OTHER PUBLICATIONS

Norwegian Search Report, Application No. 20130548, date of report Sep. 27, 2013, 2 pages.

* cited by examiner

*Primary Examiner* — Shaun R Hurley
*Assistant Examiner* — Bao-Thieu L Nguyen
(74) *Attorney, Agent, or Firm* — Nixon Peabody LLP

(57) ABSTRACT

A garment of at least one layer of fabric (303) with air vents (103) and which is further characterized in that it has a set of tubes (202) attached to the inside of the garment creating space between the garment and the body (301) of the user, the tubes (202) are elongated and run continuously at least most of the length of the garment.

5 Claims, 4 Drawing Sheets

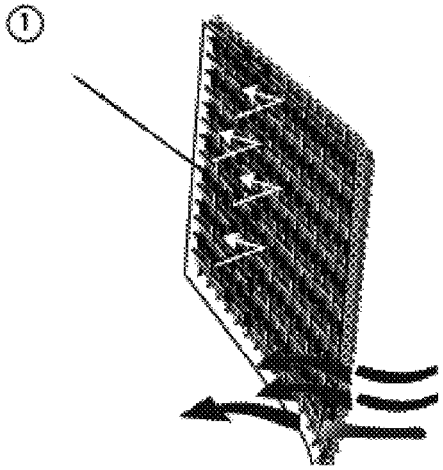
Fig. 4
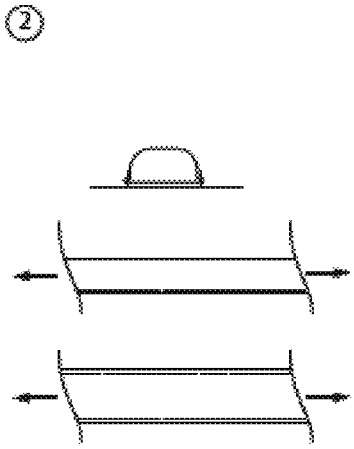
Fig. 5a
Fig. 5b
Fig. 5c
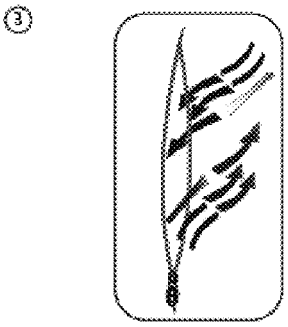
Fig. 6

GARMENT WITH AN INCORPORATED MICRO CLIMATE SYSTEM

CROSS-REFERENCE TO RELATED APPLICATION

This application claims priority to Norwegian Patent Application No. 20130548, filed on Apr. 19, 2013, the contents of which are incorporated herein by reference in its entirety.

TECHNICAL FIELD

The present invention regards a garment and more specifically a system for insulating a garment suitable for outdoor use and especially jackets suitable for outdoor use at various levels of activity and weather conditions.

BACKGROUND OF THE INVENTION

Weather shifts quickly, a sunny winter day can suddenly turn cold, and blue skies can quickly turn to snow or sleet. The body's climate can fluctuate at an even faster rate as internal temperature and perspiration levels vary during even moderate physical training. Excessive moisture in a jacket can also dramatically reduce the warmth it can provide to its wearer. These constantly varying conditions create a need for the enthusiast to manage his/her own personal climate. Until now, active people have had to basically accept that they would at various stages be either too hot or too cold. This effectively reduces their performance, comfort, and enjoyment.

Various attempts have been made to expand the comfort zone of clothes some known solutions are:

CN202286309 describes a solution comprising a jacket with vertical pockets on the inside. These tubes are meant to be filled with ice. This is in order to cool the user down while working outdoors in extreme heat. This invention is only useful in countries where the weather is so warm that it is not possible to work outdoors for longer periods of time. Hence this is not suited for places that have an opposite problem where it is normal to put on clothes in order not to freeze.

GB2344738 A comprises an invention where there are different zones around the body with different grade of insulation. This is in order to make it possible for a person to use a piece of clothing in a larger spectre of temperature. It takes into consideration the fact that the body produces a larger amount of heat in specific areas on the torso. It is therefore not necessary to insulate the entire body with the same layer of insulation.

The problem with this invention is that it only takes into consideration protecting the body against the cold. It does not solve the problem of overheating.

Jackets and outerwear such as the above, are built for use within a specific climate spectrum, e.g. for warm and sometimes rainy weather the jacket should be waterproof and not insulated. In cold and dry weather, the jacket should be heavily insulated and breathable but not water resistant. Jackets have had to be built this way to keep the wearer of the jacket comfortable when in that specific climate. The ability for a single jacket to provide protection, performance and comfort in a broader range of climates has been limited due to the lack of innovative materials and designs specifically targeting the micro climate that is created by the body's' natural perspiration and heat generated around the torso.

Jackets on the market today have limited versatility, because they have been designed with a specific climate in mind, e.g. the cold/dry jackets would not function well when it's warm/rainy. Because the external climate and the micro climate within the jacket are constantly changing, the wearer is often either too warm, too cold, or too sweaty, leaving them uncomfortable as there is little opportunity to adjust their micro climate beyond the traditional means of venting zippers—or simply removing the jacket.

SUMMARY OF THE INVENTION

It is therefore the object of the present invention, as it is stated in the set of claims to solve the problems mentioned above. This is done by introducing a garment with a micro climate system that provides the wearer with the capability to regulate their own personal climate, i.e. moisture and temperature, across a variety of outdoor conditions and activities. This is achieved through a series of proprietary elements, a novel combination of existing elements and a mechanical ventilation system.

This invention will help in moving moisture away from the garment and help the wearer to stay dry and warm.

It is created a system where the user can regulate the heat or cooling of the garment depending of outside conditions with the help of tubes, air circulation, and more rapid ventilation.

Venting is achieved via air vents, which are sized and positioned to create a negative air pressure so the excess heated air is sucked out in an efficient way.

Through the unique application of the outer barrier, insulation that provides for air circulation, and a venting system, the user is able to manage temperature and humidity in order to stay dry, comfortable and performing at their best throughout the day.

The system is based on the application of three elements:

- An outer barrier/shell that provides protection from the elements and makes sure that the user don't get wet from the outside,
- insulation that incorporates long vertical tubes giving positive and negative spaces and provides for air circulation, and
- a venting system with strategically placed in-take and out-take "air vents" that promote rapid ventilation.

The tubes start in the upper part of the chest and back area and down the entire length of the jacket. These tubes are spaced apart making channels between the tubes. These channels allow hot and moist air to rise when the jacket is vented, but also to trap air between the tubes, the body of the wearer and the shell of the jacket aiding to the insulating effect of the jacket.

BRIEF DESCRIPTION OF THE DRAWINGS

FIG. 4 is a sectional view of the multi-layered fabric of the jacket.

FIG. 5 shows the insulted tubes at three different angles, a cross sectional view, a side view and a sectional top view and a continuous top view.

FIG. 6 is a drawing of the technical feature of the air-ports.

DETAILED DESCRIPTION

Figures 1A, 1B:
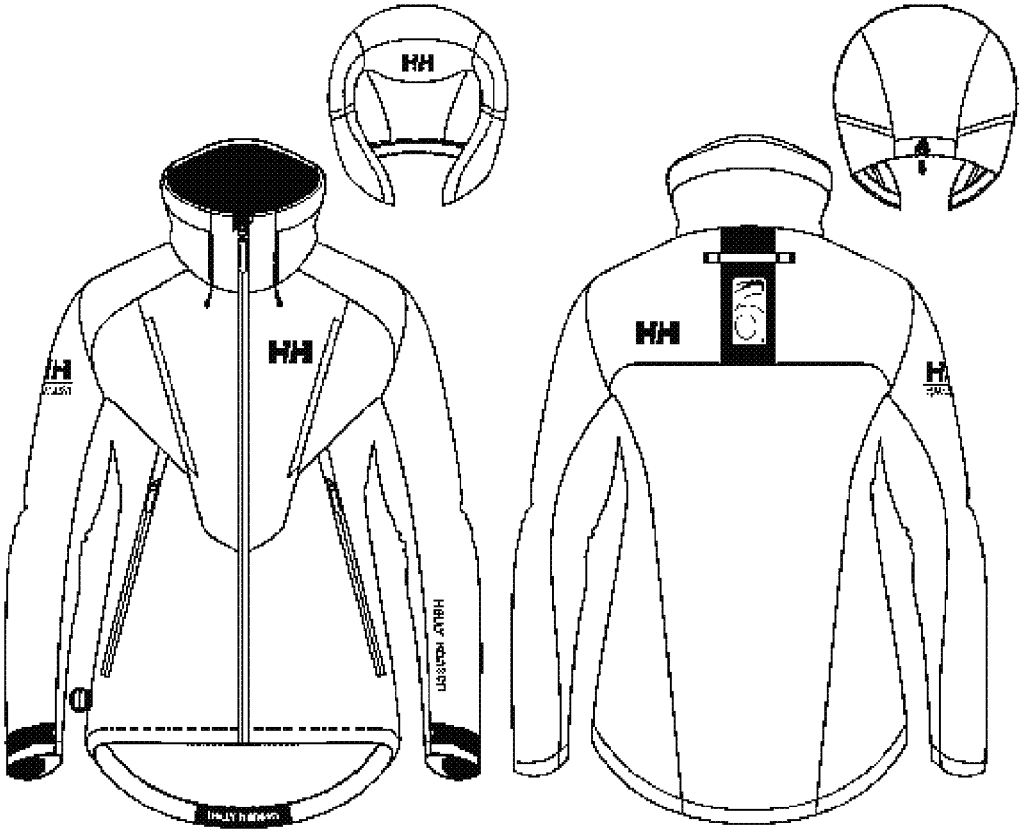
FIG. 1 is a drawing of front and back view of a jacket with the present invention incorporated.

FIG. 1 is a front and back view of a preferred embodiment of the invention. It is shown the micro climate system incorporated in a jacket 101. On the front of the jacket 101 it is placed a set of zippers 103. These zippers 103 can be closed or open according to the climate inside the jacket 101. When opened it is created air vents. These air vents allow the air on the inside of the jacket to be circulated.

On the back of the jacket it is situated at least one further zipper 103. When all zippers 103 are opened they allow for maximum ventilation. The user can choose the level of ventilation by either closing all the zippers 103, by opening some of the zippers, or by opening all of the zippers 103.

Further the jacket can preferably have a detachable hood 102.

Figure 2:
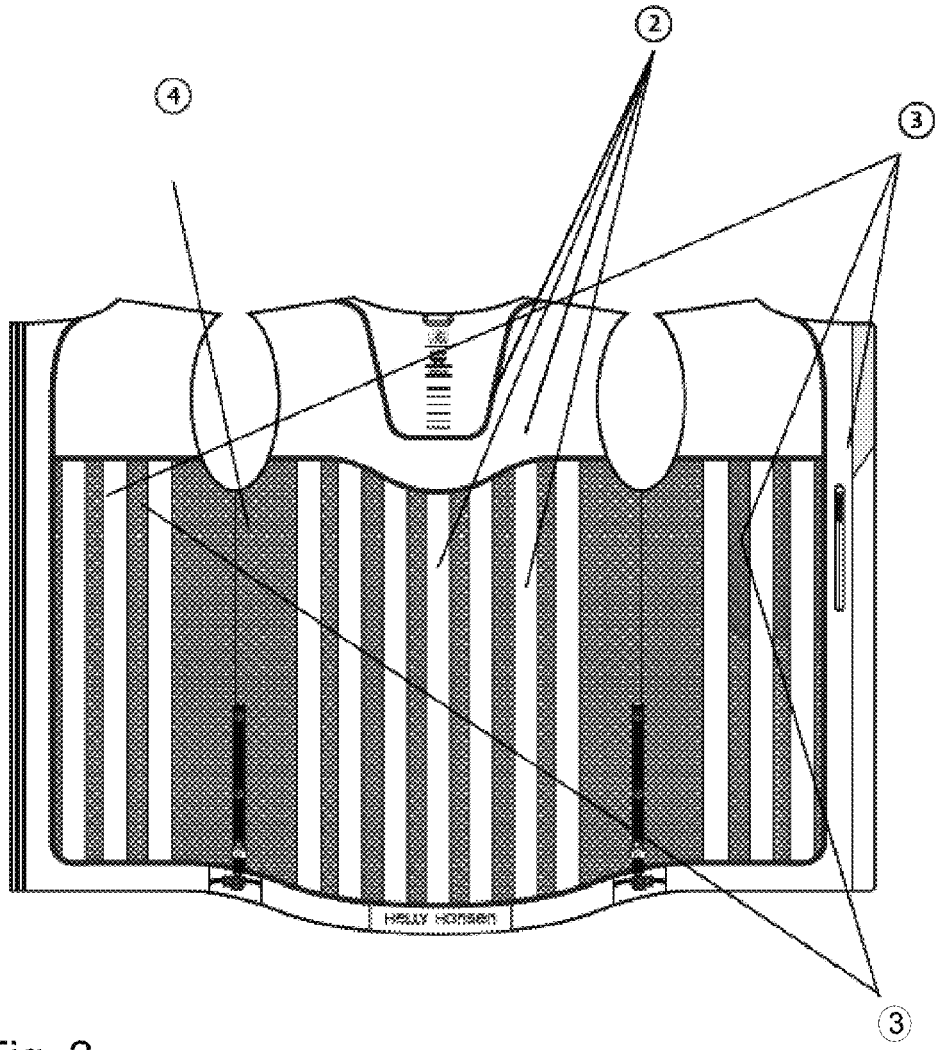
FIG. 2 is a view of the inside of a jacket with a preferred embodiment of the present invention incorporated, showing the different components of the entire system.

FIG. 2 shows the inside of a jacket 101 comprising of a preferred embodiment of the present invention. The breathable protective shell 303 allows moisture to penetrate from the inside of the jacket 101 to the outside. Further the breathable protective shell 303 stops water penetrating from the outside of the jacket 101 to the inside.

It also shows the air vents 103, situated in the front and in the back of the jacket 101.

In addition to this a number of tubes 202 are placed on the inside of the jacket 101. In a preferred embodiment of the present invention the tubes 202 starts at the upper part of the chest and back area of the inside of the jacket 101. They run vertically down to the lower part of the jacket 101. The tubes 202 are spaced apart creating channels 301 between them. The tubes 202 are filled with an insulating material. They further separate the body of the wearer from the outer shell 303 of the jacket 101.

These channels 301 allow warm, moist air to rise and to be transported out through the air vents 103 and the opening in the neck area of the jacket 101.

Further the jacket comprises an adjustment system at the lower edge of the jacket. This adjustment system allows the user to tighten and loosen the lower edge of the jacket 101 around the body. This is a further option for adjusting the ventilation of the jacket 101.

Figure 3:
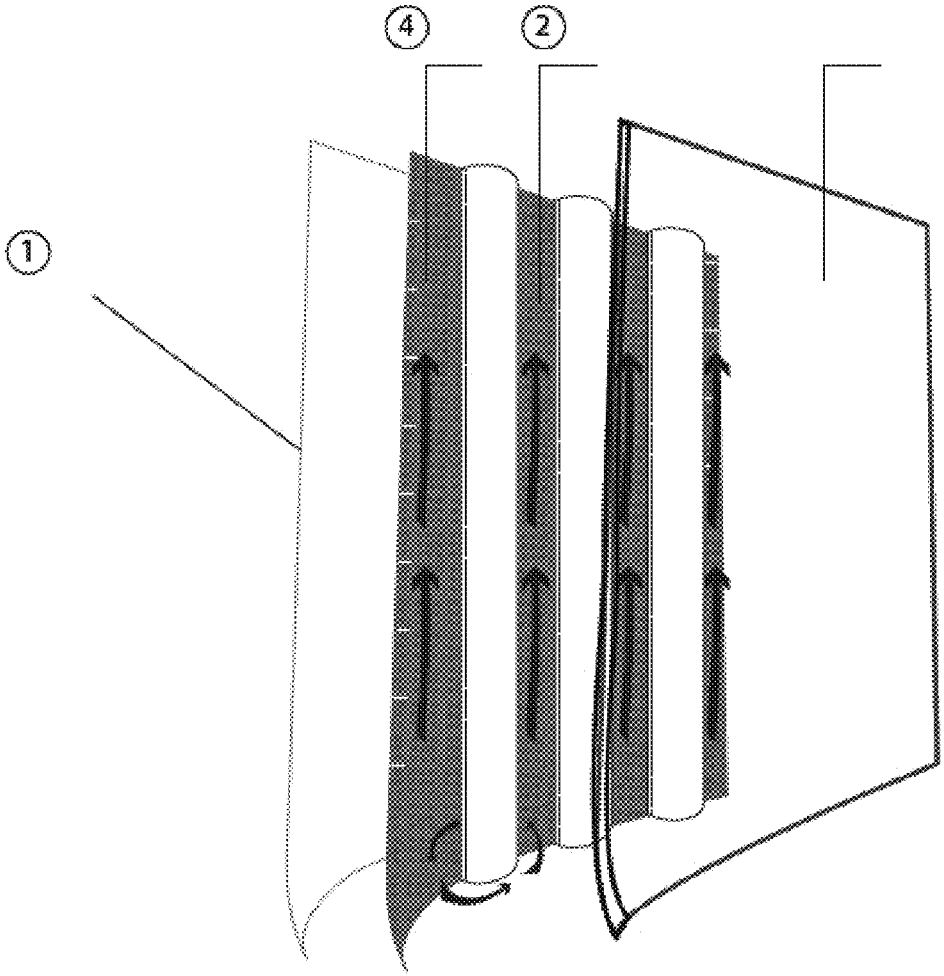
FIG. 3 is an exploded view of the different parts of the technical features of the present invention.

FIG. 3 is an exploded perspective view of the inside of a jacket 101 with the micro climate system incorporated. The system comprises a protective outer shell 303. To this outer shell 303 it is attached a lining 302. The tubes 202 are attached to the lining 302 of the jacket 101. In the space between the tubes 202 it is created a channel 301. The tubes 202 rest against the body of the user separating it from the lining 302 and the outer shell 303 from the body.

FIG. 4 is a view of the layers of a jacket 101 according to the invention. The outermost layer is a breathable protective shell 303. The layer includes an outer shell fabric, such as a polyester micro light weight rip-stop which is water repellent and can function as a wind stopper. The outer shell fabric can also be a textile covered with a water repellent and vapour permeable membrane.

FIG. 5 shows the insulted tubes 202 at three different angles, a cross sectional view, a side view and a sectional top view and a continuous top view. The tubes 202 can be of different size both in length, in width and in thickness. In alternative embodiments of the invention the tubes 202 can be either longer or shorter. The tubes 202 can e.g. go all the way up to the neck of the jacket 101.

The tubes 202 can also vary in width. They can be wider allowing for better insulation or they can be smaller allowing for better ventilation.

Further it is possible to adjust the thickness of the tubes 202. In an even further alternative embodiment of the invention the tubes 202 can be attached directly to the outer protective shell 303 of the jacket 101.

FIG. 6 shows an example of an air vent 103. In the jacket 101, there is provided air vents 103, being a mechanical ventilation system. The air vents 103 are provided in the exterior or outermost layer of the jacket 101 and can be opened and shut via opening and locking means such as zippers, VELCRO® or other hooks and loops fasteners, snap fasteners or other suitable locking means. The air vents 103 allow the wearer to regulate the flow of air into, out of and through the jacket 101.

Garments according to the present invention have a number of advantages over other garments in the marketplace. The air vents is a simple and efficient mechanical ventilation system that uses natures' elements. The micro climate system according to the invention presents a unique combination of a protective shell 303, air vents 103 and tubes 202.

While the best effects of micro climate control will be realized while combining all the elements, it is possible to combine some of the elements in unique combinations to deliver similar results.

It is also conceivable that a garment according to the invention can be realized through other elements that would provide enhanced insulation properties and increased air flow such as other combinations of insulation and air tubes 202, other synthetics, down, etc., combinations of air flow vents, insulation and exaggerated air tubes 202 or liners that enhance air flow while providing exaggerated air tubes 202 for insulation. However, for the garment or apparel according to the invention to work in an efficient manner, the garment should be provided with at least one breathing layer, at least one insulating layer and preferably at least one layer being able of transporting humidity and to some extent allow for circulation of the air.

The outermost breathable layer 303 can be a simple textile functioning as a wind stopper. It can also be a more advanced material also providing water repellent and/or vapour permeable properties. In some applications of the invention, it is beneficial to provide an outermost layer including several layers, for example a textile covered with one or more membranes with different properties or a layer where one or more textiles are adhered to each other with or without one or more membranes.

The invention can also be used in shoes, gloves, sleeping bags, blankets, backpacks and socks.

The invention claimed is:

1. A garment comprising at least one layer of fabric (303), air vents (103), and tubes (202) and which is further characterized in that the tubes (202) run at least substantially vertically from an upper part of the garment down to a lower part of the garment (101), the tubes (202) being spaced apart so as to define channels (301) therebetween, the channels communicating with the air vents, the tubes (202) are at least partially filled with an insulating material, and are elongated and run continuously at least most of the length of the garment, and that the air vents can be selectively closed to trap air in the channels to provide an insulating function or selectively opened, partially or fully, to govern airflow through the garment;

wherein the garment is a jacket and the at least substantially vertically-disposed tubes (202) and channels (301) are disposed at least in a rear portion of the garment and a front portion of the garment, wherein at least some of the air vents are disposed in a neck area of the jacket, wherein the tubes form a part of an innermost layer of the garment, wherein the channels defined between the tubes are configured to allow warm, moist air to rise upwardly and to be transported out through at least some of the air vents (103) and an opening in the neck area of the jacket.

2. A garment according to claim 1, wherein the at least one layer of fabric (303) comprises a water repellent, vapour permeable, exterior shell covering the garment.

3. A garment according to claim 1, wherein the air vents (103) are in the form of either zippers, hooks, loops, snap fasteners or any other suitable locking means.

4. A garment according to claim 1, wherein the tubes (202) are filled with an insulating material.

5. A garment according to claim 1, wherein the at least substantially vertically-disposed tubes (202) and channels (301) are disposed, circumferentially, about the rear, side and front portions of the garment.

* * * * *